United States Patent [19]

Hollenbeck

[11] 4,394,906

[45] Jul. 26, 1983

[54] FOOD CONTAINER/HOLDER

[76] Inventor: John C. Hollenbeck, 11 Mount Darwin Ct., San Rafael, Calif. 94903

[21] Appl. No.: 276,666

[22] Filed: Jun. 23, 1981

[51] Int. Cl.[3] ..... B65D 1/26; B65D 17/28; B65D 83/00

[52] U.S. Cl. ..... 206/525; 220/4 E; 229/2.5 R; 229/44 R

[58] Field of Search ..... 206/525, 218; 229/2.5 R, DIG. 13, 44 R; 220/4 E; 215/1 C

[56] References Cited

U.S. PATENT DOCUMENTS

| | | | |
|---|---|---|---|
| 2,145,481 | 1/1939 | Harvey | 229/21 |
| 2,780,378 | 2/1957 | Romano | 215/1 C |
| 2,880,902 | 4/1959 | Owsen | 220/8 |
| 2,955,044 | 10/1960 | Tupper | 229/2.5 |
| 3,148,103 | 9/1964 | Gallagher | 229/2.5 |
| 3,483,908 | 12/1969 | Donovan | 206/526 |
| 4,096,986 | 6/1978 | Florian | 229/2.5 R |
| 4,273,249 | 6/1981 | Florian | 229/DIG. 13 |
| 4,294,371 | 10/1981 | Davis | 220/4 E |

*Primary Examiner*—William T. Dixson, Jr.
*Attorney, Agent, or Firm*—Wells & Wells

[57] ABSTRACT

Food container/holder formed from foamed polymer and having a body portion of ascending corrugated bands for extruding food under hand pressure.

5 Claims, 5 Drawing Figures

FOOD CONTAINER/HOLDER

CROSS-REFERENCE TO RELATED APPLICATION

The disclosure of applicant's copending design application, Ser. No. 250,114, filed Apr. 2, 1981, is enclosed herewith to show the design aspects of the present invention.

BACKGROUND OF THE INVENTION

The field of the invention is special receptacles or packages and the present invention is particularly concerned with food containers and holders for food eaten with a bun such as hamburgers, hot dogs and fish sticks.

The state of the art of these food container/holders may be ascertained by reference to U.S. Pat. Nos. 2,915,214; 3,220,544; 3,227,308; 3,876,130 and 4,189,054, the disclosures of which are incorporated herein.

It is a common experience in America to purchase and eat from fast food restaurants and the dispensing of hot dogs, hamburgers, fish sticks and other sandwiches has become a major consumer industry.

These fast foods have been dispersed in paper bags, napkins, cardboard containers and plastic film. Now there is a trend to dispensing fast foods in foamed plastic containers such as foamed polyurethane and polystyrene containers.

The advantages of such foamed plastic food containers as disclosed in U.S. Pat. No. 3,876,130 are: permeable or ventilated packaging, protection of physical integrity and thermal insulation.

Prior art containers, including the foamed plastic containers, lack means for manipulating and advancing the food from the container while it is being consumed.

SUMMARY OF THE INVENTION

Having in mind the limitations of the prior art, it is an object of the present invention to provide a fast food container which facilitates the manipulation and advancement of the food from the container while it is being consumed.

Another object of the present invention is a container which provides thermal insulation of food contained therein.

Still another object of the present invention is storage of partially consumed food.

Yet another object of the present invention is transportation of partially consumed food.

Another object of the present invention is disposal of partially consumed food in a hygenic manner.

These and other objects of the present invention are achieved with a foamed plastic food container having a corrugated structure facilitating advancement by fingers of the consumer through an opening in the container.

BRIEF DESCRIPTION OF THE DRAWINGS

One embodiment of the present invention is shown in the accompanying drawings, wherein.

DESCRIPTION OF THE PREFERRED EMBODIMENT

Figure 1:
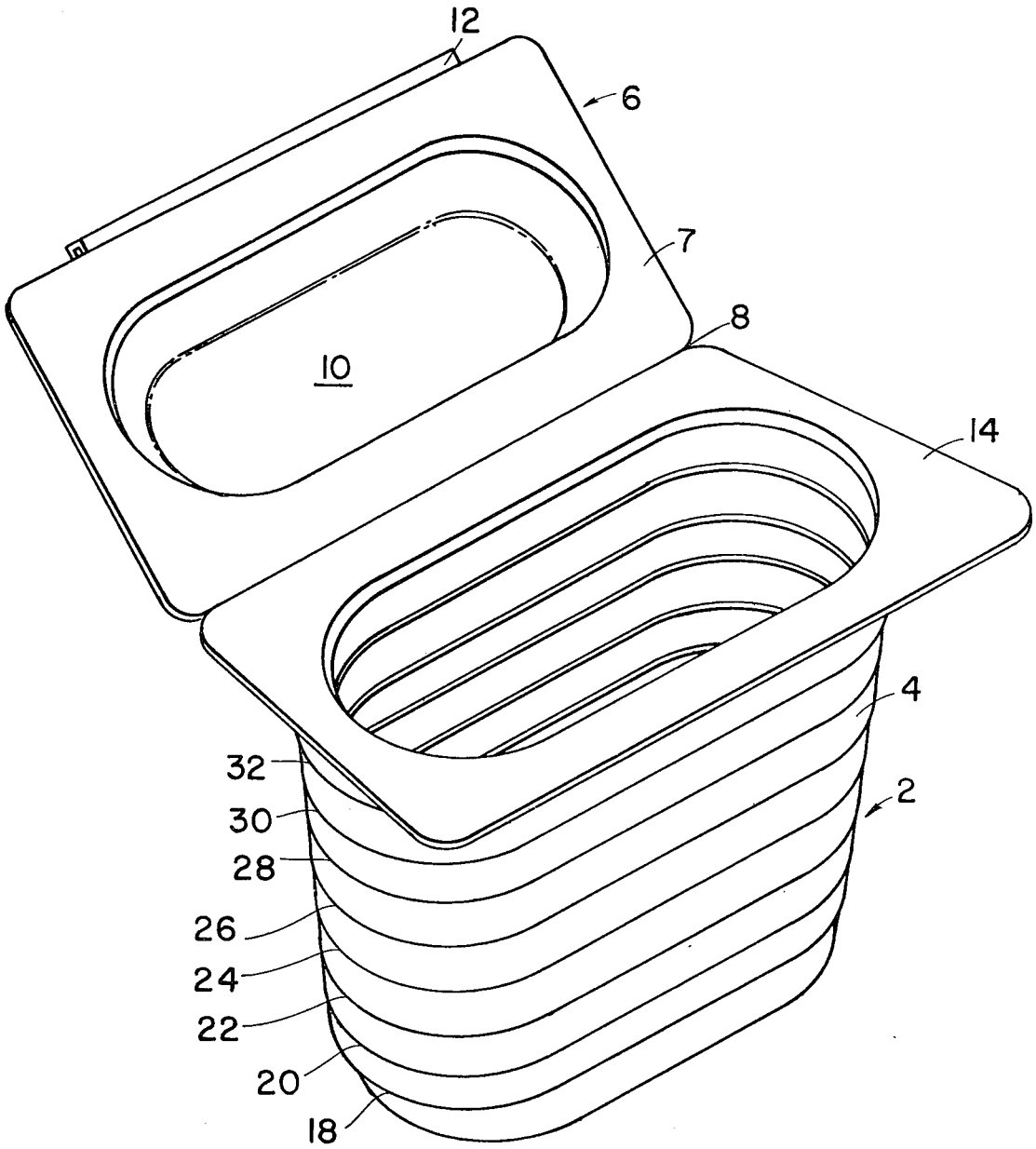
FIG. 1 is a right side perspective view of the food container/holder of the present invention with the top open.
Figure 2:
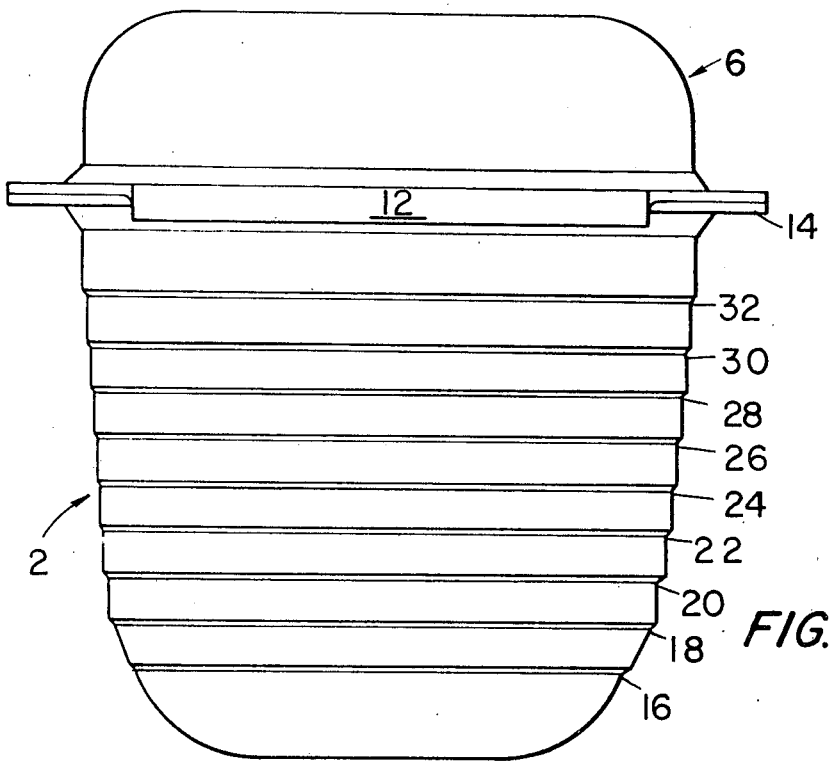
FIG. 2 is a front elevational view of the present invention with the top closed.
Figure 4:
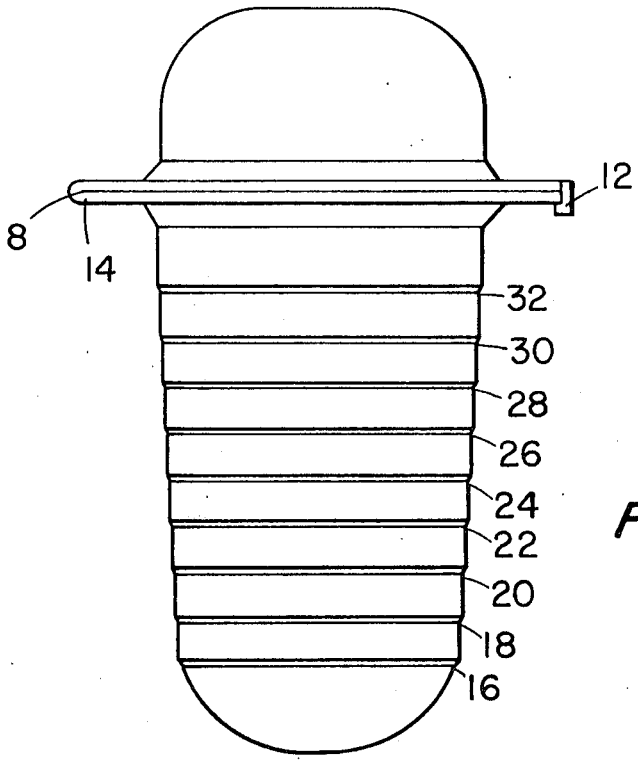
FIG. 4 is a right side elevational view of FIG. 2.
Figure 3:
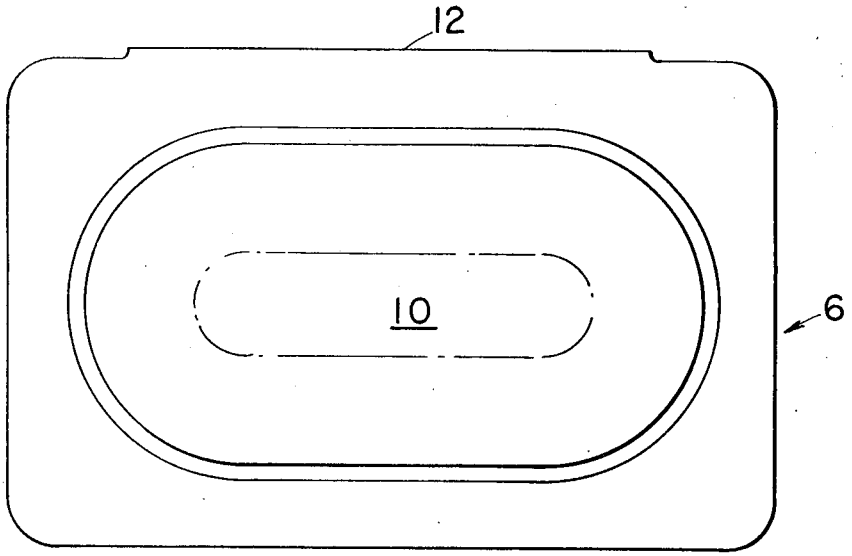
FIG. 3 is a top plan view of FIG. 2.
Figure 5:
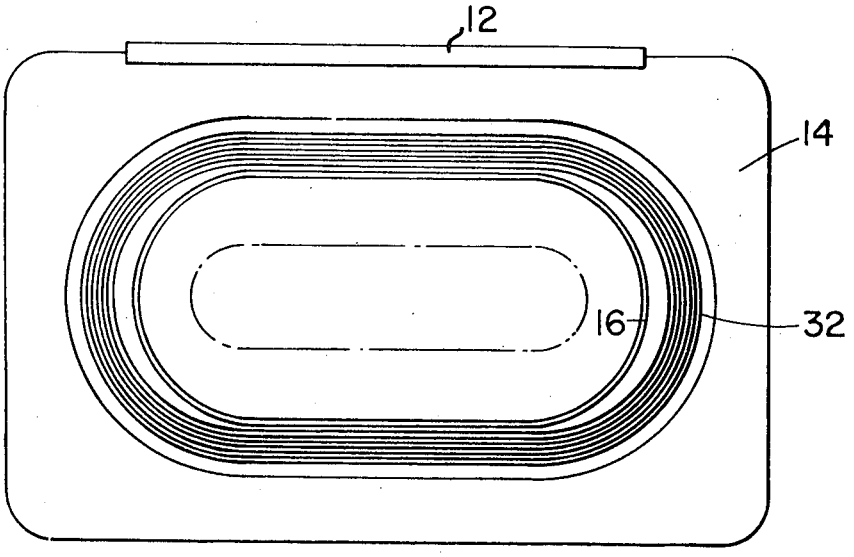
FIG. 5 is a bottom plan view of FIG. 2.

With particular reference to FIG. 1, the food container/holder 2 is shown with a bottom 4 and a top 6 integral therewith. Top 6, having a plane surface 7, is hinged with the bottom 4 at line 8 and the top has a recess 10 and L-shaped catch 12 for securing the top to plane surface 14 of the bottom.

Telescoping corrugations 16, 18, 20, 22, 24, 26, 28, 30, and 32 are molded into the bottom 4 of the food container/holder. Each descending corrugation is recessed successively from corrugation 32 down to corrugation 16.

BEST MODE OF CARRYING OUT THE INVENTION

The preferred raw materials for preparing the food container/holder of the present invention are flexible urethane polymer foams as particularly disclosed in the Kirk-Othmer Encyclopedia of Chemical Technology, 2nd edition, Vol. 21 (1970), pp. 84–90.

An 80:20 mixture of 2,4-tolylene diisocyanate and 2,6-tolylene diisocyanate is used with water to produce carbon dioxide as a blowing agent. Typical formulations are given in Tables 20–24 which appear on pages 87–90 of Kirk-Othmer, ibid.

The food container/holder can be molded by the one-shot or the prepolymer methods as disclosed in Kirk-Othmer, ibid.

After the food container/holder is molded in one piece, it is ready for use. Foods such as hamburgers, hot dogs, submarines and ice cream bars are inserted into the bottom 6.

It is possible to insert the foods frozen into the containers and refrigerate them until dispensed. In the case of the hamburgers, etc. which are normally eaten hot, they can be heated in a microwave oven such as a Radar Range without removing the food from the container.

Alternatively, the foods can be heated and then placed in the containers and the top snapped closed. The containers are therefore useful for storage before and after dispensing of the food contained therein.

In the case of ice cream or candy bars, these foods are usually dispensed cold and the container insulates the frozen foods and helps maintain the lower temperature.

The food container/holder of the present invention has the particular advantage that after being sold to a consumer, the food can be manipulated and advanced incrementally by the consumer as it is eaten.

In order to consume, for example a hamburger, the resilient catch 12 is released by a user's thumb and the top 6 is swung open. The hamburger within the inside of the bottom 2 and without any other protective covering, is fed out of the bottom by depressing first corrugation 16 followed by depression of corrugation 18, etc. to advance the hamburger being eaten.

Because of the nature of the flexible polyurethane foam construction of the container, the corrugations compressed by finger pressure will remain collapsed and the partially eaten hamberger will remain in its advanced position much as a toothpast tube is compressed to extrude toothpaste.

At any stage of the advance, the consumer can make the decision to retain the hamburger for later consumption or throw it away. All that is required is that the top be snapped closed and the surrounding insulating foam will help maintain the temperature.

Other polymer foams such as polyesters may be found useful in the manufacture of the present container but at this stage of the fast developing foamed polymer industry, polyurethane foam has the greatest advantages. Applicant has in mind the application of other suitable foamed polymers as they become available.

I claim:

1. A food container/holder comprising a unitary foamed plastic body having a bottom container portion for said food with a plurality of corrugation bands ascending from a closed bottom to an opening, said opening defined in a first plane surface, a top hinged to an edge of said first plane surface, said top having a second plane surface, with a recess therein and a catch on an edge of said second plane surface for securing said first plane surface to said second plane surface, said bottom portion having a length sufficient to contain substantially all of said food and said foamed plastic body and said corrugation bands facilitating advancement of said food through said opening and maintaining said advancement.

2. The food container/holder of claim 1, wherein said plastic body is foamed polyurethane polymer.

3. The food container/holder of claim 2, wherein said corrugation bands are oval shaped and each successive ascending band has a circumference greater than the preceding band.

4. The food container/holder of claim 3, wherein there are nine corrugation bands.

5. The food container/holder of claim 4, wherein said catch is L-shaped.

* * * * *